US007135263B2

(12) United States Patent
Kawakami et al.

(10) Patent No.: US 7,135,263 B2
(45) Date of Patent: Nov. 14, 2006

(54) TONER

(75) Inventors: Hiroaki Kawakami, Kanagawa (JP); Fumihiro Arahira, Shizuoka (JP); Masayuki Hama, Shizuoka (JP); Noriyoshi Umeda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 10/935,130

(22) Filed: Sep. 8, 2004

(65) Prior Publication Data

US 2005/0058926 A1 Mar. 17, 2005

(30) Foreign Application Priority Data

Sep. 12, 2003 (JP) ..... 2003-321836
Apr. 30, 2004 (JP) ..... 2004-135284

(51) Int. Cl.
*G03G 9/08* (2006.01)

(52) U.S. Cl. ..... 430/108.4; 430/108.3; 430/108.6; 430/108.7

(58) Field of Classification Search ..... 430/108.6, 430/108.7, 108.1, 108.3, 108.4, 6, 108
See application file for complete search history.

(56) References Cited

U.S. PATENT DOCUMENTS 5,759,731 A 6/1998 Hagi et al.
6,077,636 A 6/2000 Moriki et al. ..... 430/45
6,335,135 B1 1/2002 Arai et al. ..... 430/108.6
6,352,808 B1 * 3/2002 Hagi et al. ..... 430/108.1

FOREIGN PATENT DOCUMENTS

| | | |
|---|---|---|
| JP | 8-272132 | 10/1996 |
| JP | 10-10770 | 1/1998 |
| JP | 3047900 | 3/2000 |
| JP | 2000-162812 | 6/2000 |
| JP | 2001-296688 | 10/2001 |
| JP | 2003-277054 | * 10/2003 |
| KR | 0161562 | 3/1999 |

OTHER PUBLICATIONS

Japanese Patent Office machine-assisted translation of JP 2003-277054 (pub. Oct. 2003).*
"Japan Hardcopy '97 Papers" The Annual Conference of thee Society of Electrophotography of Japan, Jul. 1997, pp. 66-68.

* cited by examiner

*Primary Examiner*—Janis L. Dote
(74) *Attorney, Agent, or Firm*—Fitzpatrick, Cella, Harper & Scinto

(57) ABSTRACT

In a toner having toner particles which have toner base particles having at least a colorant and a binder resin, and an inorganic fine powder; the inorganic fine powder has a primary-particle average particle diameter of from 30 nm to 300 nm, and has particles having at least one of a cubic particle shape, a cube-like particle shape, a rectangular particle shape and a rectangle-like particle shape and having perovskite type crystals; and the inorganic fine powder has particles and agglomerates both having particle diameters of 600 nm or more, in a content of 0% to 1% by number.

12 Claims, 3 Drawing Sheets

TONER

BACKGROUND OF THE INVENTION

1. Field of the Invention

This invention relates to a toner used in recording processes utilizing electrophotography or electrostatic recording. More particularly, this invention relates to a toner used in copying machines, printers or facsimile machines in which an electrostatic latent image formed on an electrostatic latent image bearing member is developed with a toner to form a toner image on the electrostatic latent image bearing member, the toner image on the electrostatic latent image bearing member is transferred to a transfer material via, or no via, an intermediate transfer member, and the toner image on the transfer material is fixed thereto to form a fixed image.

2. Related Background Art

The electrophotography is a process in which an electrostatic latent image bearing member formed of a photoconductive substance is electrostatically charged by various means and is further exposed to light to form an electrostatic latent image on the surface of the electrostatic latent image bearing member, the electrostatic latent image is then developed with a toner to form a toner image, the toner image is transferred to a transfer material such as paper, and the toner image transferred to the transfer material is fixed to the transfer material by the action of heat or pressure or heat and pressure to obtain a copy or a print.

However, when such an image formation process is repeated in a large number especially in a high-humidity environment, ozone produced in the step of charging where the electrostatic latent image bearing member is electrostatically charged may react with oxygen in air to turn into nitrogen oxides (NOx), and these nitrogen oxides may further react with water in air to turn into nitric acid to come to adhere to the surface of the electrostatic latent image bearing member, resulting in a lowering of surface resistance of the electrostatic latent image bearing member. This may cause smeared images on the electrostatic latent image bearing member at the time of image formation. As measures against such smeared images, a method is known in which particles having abrasive action are added to toner base particles to strip charge products having adhered to the surface of the electrostatic latent image bearing member to make an improvement. However, such an abrasive agent has a large particle diameter and a broad particle size distribution, and hence it has been difficult to uniformly abrade the surface of the electrostatic latent image bearing member.

As methods having made an improvement in this regard, methods are proposed as disclosed in Japanese Patent Application Laid-Open No. H10-10770 and Japanese Patent No. 3047900 in which strontium titanate powder is added to toner base particles. The strontium titanate powder used in these methods has fine particle diameter and contain only a few coarse particles, and hence has good abrasive effect. The strontium titanate powder used in these methods is effective for preventing filming or melt adhesion from being caused by the toner to the electrostatic latent image bearing member. However, this powder has been insufficient for removing the above charge products.

As disclosed in Japanese Patent Application Laid-Open No. 2000-162812, a method is proposed in which toner base particles containing an abrasive substance and a fatty acid metal salt are used; in Japanese Patent Application Laid-Open No. H08-272132, a method in which a fatty acid metal salt and a titanic acid compound are externally added to toner base particles; and in Japanese Patent Application Laid-Open No. 2001-296688, a method in which a metal oxide surface-treated with a lubricant such as a fatty acid metal salt is externally added to toner base particles. However, these methods have all been insufficient for removing the charge products.

SUMMARY OF THE INVENTION

An object of the present invention is to provide a toner having solved the above problems.

Another object of the present invention is to provide a toner having superior properties to restrain or prevent smeared images from occurring at the time of image formation in a high-humidity environment.

To achieve the above objects, the present invention provides a toner comprising toner particles which comprise toner base particles having at least a colorant and a binder resin, and an inorganic fine powder, wherein;

the inorganic fine powder has a primary-particle average particle diameter of from 30 nm to 300 nm, and has particles having at least one of a cubic particle shape, a cube-like particle shape, a rectangular particle shape and a rectangle-like particle shape and having perovskite type crystals; and the inorganic fine powder has particles and agglomerates both having particle diameters of 600 nm or more, in a content of 0% to 1% by number.

DESCRIPTION OF THE PREFERRED EMBODIMENTS

Figure 1:
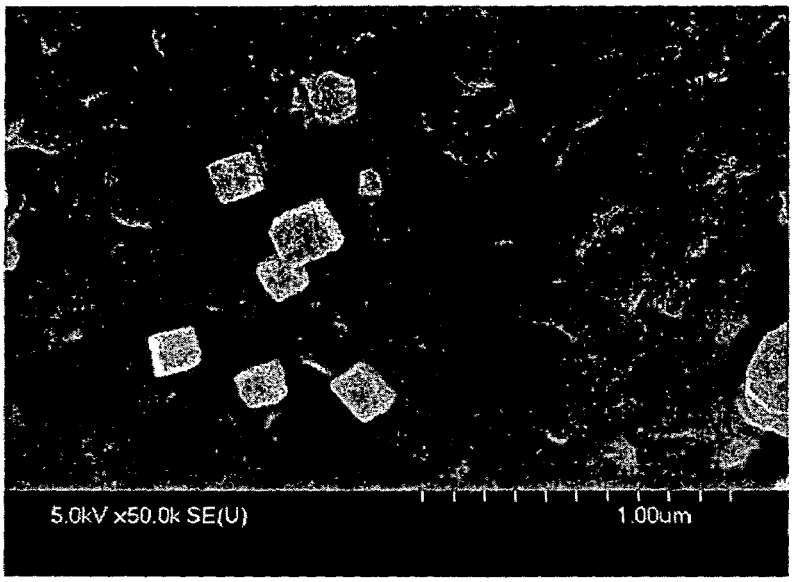
FIG. 1 is a view showing an image made up by drawing an electron microscope photograph (magnification: 50,000) of Inorganic Fine Powder D shown in Production Example 4 of a perovskite type crystal inorganic fine powder.

According to the present invention, a substance having a superior abrasive effect and capable of removing charge products is added to toner base particles to provide a toner. This enables prevention of smeared images in a high-humidity environment, and also enables image formation which is fog-free and can attain sufficient image density.

The present invention is described below in greater detail by giving preferred embodiments.

As a result of extensive studies, the present inventors have discovered that the above image formation may be performed using a toner in which an inorganic fine powder of specific perovskite type crystals has externally been added to toner base articles, and this enables a remedy of the smeared images at the time of image formation in a high-humidity environment.

As to the reason why the image formation performed using particles having an abrasive effect (hereinafter "abrasive agent") enables prevention of filming or melt adhesion of toner to the surface of the electrostatic latent image bearing member (photosensitive member), it is considered as follows: The toner having remained on the electrostatic latent image bearing member after the transfer step of an image formation process is scraped off by a cleaning blade provided in contact with the electrostatic latent image bearing member, and is sent to a cleaner, where part of the toner remains in the vicinity of the cleaning blade. At this point, since the abrasive agent has been added to the toner, it follows that the abrasive agent rubs the surface of the electrostatic latent image bearing member under a pressure at which the cleaning blade comes into contact with the electrostatic latent image bearing member. What has adhered to the surface of the electrostatic latent image bearing member in convexes in a size of from hundreds of nm to tens of μm, like that of filming or melt adhesion, passes the cleaning blade, where it follows that the abrasive agent acts at a further large pressure. Thus, more efficient abrasive effect can be obtained at the part of filming or melt adhesion.

However, ionic substances such as charge product nitrate ions have very thinly adhered to the surface of the electrostatic latent image bearing member. In order to efficiently remove the ionic substances, one may contemplate to, e.g., make the contact pressure of the cleaning blade higher. In such a case, however, the electrostatic latent image bearing member may abrade to shorten the lifetime of the electrostatic latent image bearing member, undesirably. Accordingly, in order to remove the charge products having adhered to the surface of the electrostatic latent image bearing member, without making the cleaning blade contact pressure higher, it is necessary to improve abrasion ability of the abrasive agent itself.

The conventional strontium titanate powder has been insufficient for removing the charge products.

The present inventors have considered that this is due to the shape of particles contained in the fine strontium titanate powder.

The conventional strontium titanate powder is produced through a sintering step, and has a particle shape which is a spherical shape or a closely-spherical polygonal shape. Hence, the strontium titanate powder has a small area of contact with the surface of the electrostatic latent image bearing member, or it tends to slip through the cleaning blade and can not easily stagnate in the vicinity of the cleaning blade. For these reasons, the strontium titanate powder has been insufficient for removing the charge products, as so presumed.

The present inventors have discovered that the charge products having adhered to the surface of the electrostatic latent image bearing member can efficiently be removed by using, as an abrasive agent added externally to toner base particles, an inorganic fine powder of perovskite type crystals having particle shape which is cubic, cube-like, rectangular and/or rectangle-like. Inasmuch as the particle shape of the abrasive agent is cubic, cube-like, rectangular and/or rectangle-like, the area of contact between the abrasive agent and the surface of the electrostatic latent image bearing member can be made large. Also, ridges of cubes and/or rectangles of the abrasive agent come into contact with the surface of the electrostatic latent image bearing member. This enables achievement of good toner scrape-off performance.

The inorganic fine powder used in the present invention has a crystal-structure of perovskite type. Among inorganic fine powders of perovskite type crystals, particularly preferred are fine strontium titanate powder, fine barium titanate powder, and fine calcium titanate powder. In particular, fine strontium titanate powder is more preferred.

The inorganic fine powder of perovskite type crystals used in the present invention has a primary-particle average particle diameter of from 30 nm to 300 nm, preferably from 40 nm to 300 nm, and more preferably from 40 nm to 250 nm. If the inorganic fine powder has an average particle diameter of less than 30 nm, its particles may have an insufficient abrasive effect at the part of a cleaner. If on the other hand it has an average particle diameter of more than 300 nm, the abrasive effect may be so strong as to cause scratches on the electrostatic latent image bearing member (photosensitive member). Hence, such an inorganic fine powder is unsuitable.

The inorganic fine powder of perovskite type crystals is not necessarily present in the form of primary particles and may also be present in the form of agglomerates, on the surfaces of toner base particles. In the latter case as well, good results are obtainable as long as agglomerates having particle diameters of 600 nm or more are in a content of 1% by number or less. If the inorganic fine powder has particles and agglomerates both having particle diameters of 600 nm or more, in a content of more than 1% by number, such a powder may cause scratches on the electrostatic latent image bearing member even if its primary particle diameter is less than 300 nm. Thus such a powder is unsuitable.

As to the average particle diameter of the inorganic fine powder of perovskite type crystals in the present invention, particle diameters of 100 particles picked from a photograph taken on an electron microscope at magnifications of 50,000 are measured, and their average value is found. The particle diameter is determined as (a+b)/2 where the longest side (length) of a primary particle is represented by a and the shortest side (breadth) by b.

In the inorganic fine powder of perovskite type crystals used in the present invention, the particles having the cubic particle shape and/or rectangular particle shape may be in a content of 50% by number or more. This is preferable because the charge products can more efficiently be removed.

In the present invention, it is further preferable for the inorganic fine powder of perovskite type crystals to be in a liberation percentage of 20% by volume or less with respect to toner base particles (colored particles), and more preferably 15% by volume or less. Herein, the liberation percentage refers to a value obtained when the proportion of perovskite type crystal inorganic fine powder standing liberated from toner base particles is found as % by volume, and is measured with a particle analyzer (PT1000, manufactured by Yokogawa Electric Corporation). Stated more specifically, on the basis of the simultaneousness of light emission of carbon atoms which are constituent elements of the binder resin and light emission of constituent atoms of the perovskite type crystal inorganic fine powder, the liberation percentage is defined to be one found from the following expression where "volume of light emission of only constituent atoms of the perovskite type crystal inorganic fine powder" is represented by light emission volume A, and "volume of light emission of constituent atoms of the perovskite type crystal inorganic fine powder having emitted light simultaneously with carbon atoms" by light emission volume B.

$$\text{Liberation percentage (\% by volume)}=(A/(B+A))\times 100.$$

The above liberation percentage may be measured with the above particle analyzer on the basis of the principle described in Japan Hardcopy'97 Papers, pages 65–68 (publisher: The Society of Electrophotography; published: Jul. 9, 1997). Stated specifically, in the above analyzer, fine particles such as toner particles are individually led into plasma, and the element(s) which emit(s) light, number of particles and particle diameter of particles can be known from emission spectra of the fine particles.

Here, as to "having emitted light simultaneously with carbon atoms" refers to the light emission of constituent atoms of the perovskite type crystal inorganic fine powder having emitted light within 2.6 msec after the light emission of carbon atoms. Then, the light emission of constituent atoms of the perovskite type crystal inorganic fine powder after that is regarded as light emission of only the constituent atoms of the perovskite type crystal inorganic fine powder. In the present invention, as to the light emission of constituent atoms of the perovskite type crystal inorganic fine powder having emitted light simultaneously with carbon atoms, the perovskite type crystal inorganic fine powder having adhered to the surfaces of toner base particles is measured, and it follows that, as to the light emission of only constituent atoms of the perovskite type crystal inorganic fine powder, the perovskite type crystal inorganic fine powder standing liberated from toner base particles is measured. Using these, the liberation percentage is determined.

As a specific measuring method, measurement is made in an environment of 23° C. and humidity 60%, using helium gas containing 0.1% by volume of oxygen. As a toner sample, a sample having been moisture conditioned by leaving it overnight in the same environment is used in the measurement. Carbon atoms are measured in channel 1 (measurement wavelength: 247.860 nm), and constituent atoms of the inorganic fine powder in channel 2 (e.g., strontium atoms in the case of strontium titanate; measurement wavelength: 407.770 nm). Sampling is so carried out that the number of light emission of carbon atoms comes to be 1,000 to 1,400 in one scanning, and the scanning is repeated until the number of light emission of carbon atoms comes to be 10,000 atoms or more in total, where the number of light emission is calculated by addition. Here, the measurement is made by sampling carried out in such a way that, in distribution given by plotting the number of light emission of carbon atoms as ordinate and the cubic root voltage of carbon atoms as abscissa, the distribution has one peak and also no valley is present therein. Then, on the basis the data thus obtained, the liberation percentage is calculated using the above calculation expression, setting the noise-cut level of all elements at 1.50 V. In the present invention, the liberation percentage of the perovskite type crystal inorganic fine powder with respect to toner base particles may be made to be 0 to 20% by volume. This enables more effective removal of the charge products.

The inorganic fine powder of perovskite type crystals used in the present invention is formed of particles having a cubic shape, a cube-like shape, a rectangular shape and/or a rectangle-like shape, and hence can not easily slip through the cleaning blade, compared with particles having a spherical shape or a closely-spherical polygonal shape. However, since it has very fine particle diameter, it may slip through the cleaning blade in part. It has been ascertained that the particles having slipped through the cleaning blade are those which are present alone, standing liberated from toner base particles. Thus, it has been ascertained that the liberation percentage of the perovskite type crystal inorganic fine powder with respect to toner base particles may be made to be 0 to 20% by volume, and this can prevent the inorganic fine powder of perovskite type crystals from slipping through the cleaning blade, can make it readily stagnate in the vicinity of the cleaning blade, and is effective for removing the charge products. Keeping the inorganic fine powder of perovskite type crystals from slipping through the cleaning blade can keep the charging member from its contamination to prevent faulty charging, and this can also keep a fog phenomenon from occurring. In the present specification, the cube-like particle shape and the rectangle-like particle shape mean that the shapes include the shape in which the edges of the particles are broken.

Externally adding to toner base particles fine particles having a BET specific surface area of from 100 to 350 $m^2/g$ is preferable for the toner to be provided with appropriate fluidity and chargeability. Where the inorganic fine powder is used together with such fine particles having a BET specific surface area of from 100 to 350 $m^2/g$, the toner can have a good effect on the prevention of smeared images in a high-humidity environment as a whole. For example, the fine particles can be hydrophobic fine silica particles. However, as a result of further studies made by the present inventors, it has revealed that there is a possibility of causing smeared images when image formation is performed in a high-humidity environment after image formation with a high print percentage has been performed on a large number of sheets in a low-humidity environment.

As to the cause thereof, the following has been ascertained. Even where image formation is repeated in a low-humidity environment, nitrogen oxides accumulate on the surface of the electrostatic latent image bearing member like the case of the image formation in a high-humidity environment. Further, where image formation with a high print percentage is performed on a large number of sheets, the fine particles contained in the toner adhere to the cleaning blade in a large quantity, and the fine particles adhere likewise in a large quantity to the particle surfaces of the inorganic fine powder that adheres onto the cleaning blade to abrade the surface of the electrostatic latent image bearing member. Hence, no sufficient abrasive action is obtainable. Thus, there is the possibility of causing smeared images when image formation is performed in a high-humidity environment after image formation with a high print percentage has been performed on a large number of sheets in a low-humidity environment.

Incidentally, the phenomenon as stated above has not been ascertained when image formation is merely performed in a high-humidity environment.

It has been found that, in the case when the inorganic fine powder and the fine particles having a BET specific surface area of from 100 to 350 $m^2/g$ are used in combination as external additives, surface treatment of the inorganic fine powder with a fatty acid having 8 to 35 carbon atoms or a metal salt of a fatty acid having 8 to 35 carbon atoms can remedy adhesion of the fine particles to the cleaning blade.

The fatty acid or a metal salt thereof with which the inorganic fine powder of perovskite type crystals is to be surface treated may more preferably have 10 to 30 carbon atoms. If it has 35 or more carbon atoms, the adherence between the particle surfaces of the inorganic fine powder of perovskite type crystals and the fatty acid or a metal salt thereof may lower, and the fatty acid or a metal salt thereof may come off the particle surfaces of the inorganic fine powder as a result of long-term service, resulting in a lowering of running performance, and the fatty acid or fatty acid metal salt that have come off may cause fog, undesirably. If the fatty acid or fatty acid metal salt has less than 8 carbon atoms, the effect of preventing adhesion of the fine particles having a BET specific surface area of from 100 to 350 $m^2/g$ may lower.

The treatment with the fatty acid or a metal salt thereof on the inorganic fine powder may preferably be in an amount of from 0.1 to 15.0% by weight, and more preferably from 0.5 to 12.0% by weight, based on the inorganic fine powder base material.

The above remedy of adhesion to the cleaning blade has not been seen when the inorganic fine powder of perovskite type crystals is surface-treated with any of treating agents such as a silicone oil, a silane coupling agent and a titanium coupling agent which are commonly used to improve hydrophobicity of external additives. This is considered due to the fact that the fatty acid or fatty acid metal salt has superior releasability to remedy the adhesion to the cleaning blade, whereas the silicone oil, the silane coupling agent and the titanium coupling agent, though having superior hydrophobicity, have inferior releasability to the fine particles having a BET specific surface area of from 100 to 350 $m^2/g$.

In order to prevent toner charge quantity from lowering in a development process because of moisture absorption of the inorganic fine powder in a high-humidity environment, the surface-treated inorganic fine powder of perovskite type crystals may preferably have a BET specific surface area of from 10 to 45 $m^2/g$. Controlling its specific surface area to 10 to 45 $m^2/g$ can keep small the absolute quantity of water adsorptive on the particle surfaces of the inorganic fine powder, and hence any influence on triboelectric charging of the toner can be made small.

The BET specific surface area is measured with AUTOSOBE 1 (manufactured by Yuasa Ionics Co.), and is calculated using the BET multi-point method.

In addition, in order that the fine particles having a BET specific surface area of from 100 to 350 $m^2/g$ are prevented from adhering to the particle surfaces of the inorganic fine powder of perovskite type crystals in a low-humidity environment, it is more preferable that the perovskite type crystal inorganic fine powder having been treated with the fatty acid or a metal salt thereof has a contact angle with water of from 110° to 180°.

The contact angle is measured in the following way. The inorganic fine powder of perovskite type crystals is pressed by means of a tableting machine under pressure of 300 $kN/cm^2$, into samples of 38 mm in diameter. At the time of tableting, NP-Transparency TYPE-D is sandwiched between the tableting machine and the sample to carry out tableting. The samples are left for 2 minutes at 23° C. and 100° C. each, and thereafter returned to room temperature, and the contact angle is measured with a roll material contact angle meter CA-X Roll Type (manufactured by Kyowa Interface Science Co., Ltd.). Measurement is made 20 times for each sample to find an average value of measured values on 18 samples, excluding the maximum value and the minimum value.

In order to make developing performance good, the perovskite type crystal inorganic fine powder having been treated with the fatty acid or a metal salt thereof may preferably have a charge quantity of from 10 to 80 mC/kg as absolute value, and also may preferably have a charge polarity which is reverse to the polarity of the fine particles having a BET specific surface area of from 100 to 350 $m^2/g$.

The charge quantity is measured in the following way.

Figure 4:
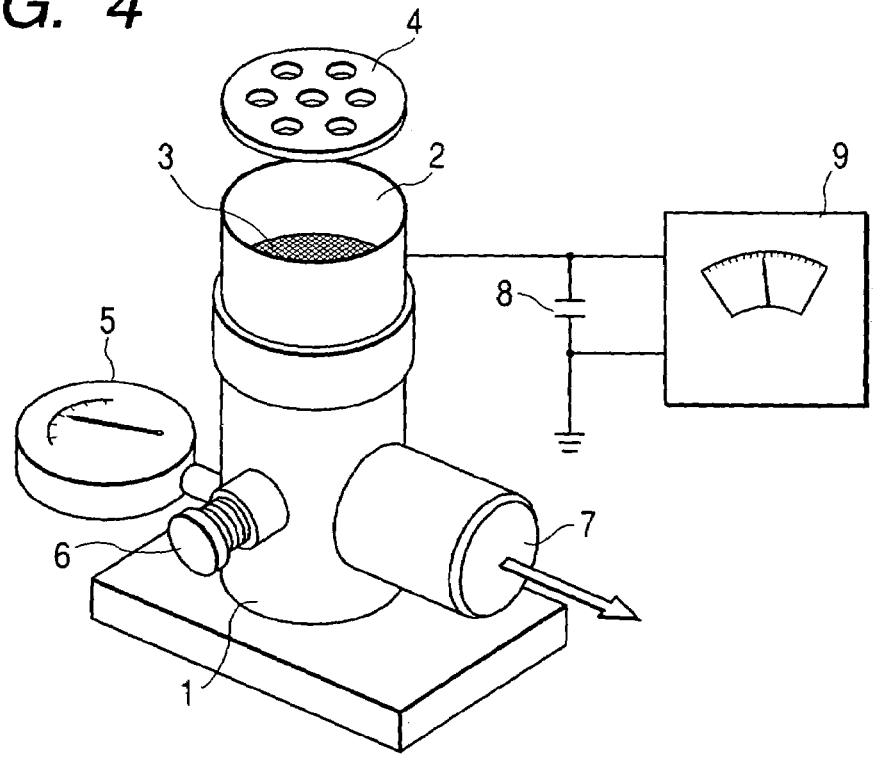
FIG. 4 is a schematic illustration of a charge quantity measuring device used in the present invention.

In an environment of a temperature of 23° C. and a relative humidity of 60%, a mixture prepared by adding 0.1 g of a measuring sample (developer) to 9.9 g of iron powder (DSP138, available from Dowa Iron Powder Co., Ltd.) is put into a 50 ml volume of bottle made of polyethylene, and this is shaken 1000 times. Next, about 0.5 g of this mixture is put into a measuring container 2 as shown in FIG. 4, made of a metal at the bottom of which a screen 3 of 32 μm in mesh opening is provided, and the container is covered with a plate 4 made of a metal. The total weight of the measuring container 2 in this state is weighed and is expressed by $W_1$ (g). Next, in a suction device 1 (made of an insulating material at least at the part coming into contact with the measuring container 2), air is sucked from a suction opening 7 and an air-flow control valve 6 is operated to control the pressure indicated by a vacuum indicator 5, so as to be 250 mm Aq. In this state, suction is carried out for about 2 minutes to remove the developer by suction. The electric potential indicated by a potentiometer 9 at this point is expressed by V (volt). In FIG. 4, reference numeral 8 denotes a capacitor., whose capacitance is expressed by C (μF). The total weight of the measuring container after the suction has been completed is also weighed and is expressed by $W_2$ (g). The triboelectric charge quantity (mC/kg) of this developer is calculated as shown by the following expression.

$$\text{Triboelectric charge quantity} = CV/(W_1 - W_2)$$

The inorganic fine powder of perovskite type crystals used in the present invention may be synthesized by, e.g., adding a hydroxide of strontium to a dispersion of a titania sol obtained by adjusting the pH of a water-containing titanium oxide slurry obtained by hydrolysis of an aqueous titanyl sulfate solution, followed by heating to reaction temperature. The pH of the water-containing titanium oxide slurry may be adjusted to 0.5 to 1.0, whereby a titania sol having good crystallinity and particle diameter can be obtained.

For the purpose of removing ions adsorbed on titania sol particles, it is also preferable to add an alkaline substance such as sodium hydroxide to the dispersion of titania sol. Here, in order to make sodium ions or the like not adsorbed on the particle surfaces of water-containing titanium oxide, it is preferable for the pH of the slurry not to be made to 7 or more. Also, the reaction temperature may preferably be 60° C. to 100° C. In order to attain the desired particle size distribution, the heating rate may preferably be controlled to be 30° C./hour or less, and the reaction time may preferably be 3 to 7 hours.

As methods by which the inorganic fine powder produced in the manner as described above is surface-treated with the fatty acid or a metal salt thereof, the following methods are available. For example, in an atmosphere of Ar gas or $N_2$ gas, an inorganic fine powder slurry may be introduced into an aqueous fatty-acid sodium salt solution to make the fatty acid deposited to perovskite type crystal surfaces. Also, for example, in an atmosphere of Ar gas or $N_2$ gas, an inorganic fine powder slurry may be introduced into an aqueous fatty-acid sodium salt solution, and a desired aqueous metal salt solution may be dropwise added thereto with stirring to make the fatty acid metal salt deposited to and adsorbed on perovskite type crystal surfaces. For example, an aqueous sodium stearate solution and aluminum sulfate may be used, whereby aluminum stearate can be adsorbed.

As the colorant used in the toner base particles in the present invention, any colorants such as dyes and pigments used in conventionally known toners may be used.

There are no particular limitations on processes for producing the toner base particles in the present invention. Usable are suspension polymerization, emulsion polymerization, association polymerization and kneading pulverization.

A process for producing the toner base particles by suspension polymerization is described below. A monomer composition prepared by adding to a polymerizable monomer the colorant, and besides optionally a low-softening substance (such as a wax), a polar resin, a charge control agent and a polymerization initiator, which are uniformly dissolved or dispersed by means of a homogenizer or an ultrasonic dispersion machine, is dispersed in an aqueous medium containing a dispersion stabilizer, by means of a stirrer, a homogenizer or a homomixer. Here, stirring speed and stirring time are controlled so that droplets of the monomer composition can have the desired toner base particle size, to effect granulation. After the granulation, stirring may be carried out to such an extent that the state of particles of the monomer composition is maintained and also the particles of the monomer composition can be prevented from settling, by the action of the dispersion stabilizer. The polymerization may be carried out at a polymerization temperature set at 40° C. or more, usually from 50° C. to 90° C. At the latter half of the polymerization reaction, the temperature may be raised, and also some of water or some of the aqueous medium may be removed at the latter half of the reaction or after the reaction has been completed, in order to remove unreacted polymerizable monomers and by-products which may cause a smell at the time of fixing of toner. After the reaction has been completed, the toner base particles formed are collected by washing and filtration, followed by drying. In the suspension polymerization, water may preferably be used as a dispersion medium usually in an amount of from 300 to 3,000 parts by weight based on 100 parts by weight of the monomer composition.

The particle size distribution and particle diameter of the toner base particles may be controlled by a method in which the pH of the aqueous medium at the time of granulation is adjusted and the types and amounts of a sparingly water-soluble inorganic salt and a dispersant having the action of protective colloids are changed, or by controlling the conditions for agitation in a mechanical agitator (such as the peripheral speed of a rotor, pass times, and the shape of agitation blades), the shape of the reaction vessel, or the concentration of solid matter in the aqueous medium.

The polymerizable monomer used in the suspension polymerization may include styrene; styrene derivatives such as o-, m- or p-methylstyrene, and m-or p-ethylstyrene; acrylic or methacrylic ester monomers such as methyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and butadiene, isoprene, cyclohexene, acrylo- or methacrylonitrile, and acrylic acid amide.

As the polar resin added at the time of polymerization, preferably usable are a copolymer of styrene and acrylic or methacrylic acid, a maleic acid copolymer, a polyester resin and an epoxy resin.

The low-softening substance used in the present invention may include paraffin waxes, polyolefin waxes, Fischer-Tropsch waxes, amide waxes, higher fatty acids, ester waxes, and derivatives of these, or graft or block compounds of these.

As the charge control agent used in the present invention, any known agents may be used. Particularly preferred are charge control agents free of polymerization inhibitory action and having no component soluble in the aqueous medium. As specific compounds, negative type ones may include metal compounds of salicylic acid, naphthoic acid, dicarboxylic acid and derivatives thereof, polymeric compounds having a sulfonic acid in the side chain, boron compounds, urea compounds, silicon compounds, and carixarene. Positive type ones may include quaternary ammonium salts, polymer type compounds having the quaternary ammonium salt in the side chain, guanidine compounds, and imidazole compounds. Any of these charge control agents may be used in an amount of from 0.2 to 10 parts by weight based on 100 parts by weight of the polymerizable monomer.

The polymerization initiator used in the present invention may include azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroxyperoxide, 2,4-dichlorobenzoyl peroxide and lauroyl peroxide. The polymerization initiator may commonly be used in an amount of from 0.5 to 20% by weight based on the weight of the polymerizable monomer, which varies depending on the intended degree of polymerization. The polymerization initiator may a little vary in type depending on the methods for polymerization, and may be used alone or in the form of a mixture, making reference to its 10-hour half-life period temperature.

The dispersion stabilizer in the suspension polymerization may include, as inorganic compounds, calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials, and ferrite. As organic compounds, it may include polyvinyl alcohol, gelatin, methyl cellulose, methyl hydroxypropyl cellulose, ethyl cellulose, carboxymethyl cellulose sodium salt, and starch. Any of the dispersion stabilizers may preferably be used in an amount of from 0.2 to 2.0 parts by weight based on 100 parts by weight of the polymerizable monomer.

As the dispersion stabilizers, those commercially available may be used as they are. In order to obtain dispersed particles having a fine and uniform particle size, however, the inorganic compound may be formed in the dispersion medium under high-speed agitation. For example, in the case of calcium phosphate, an aqueous sodium phosphate solution and an aqueous calcium chloride solution may be mixed under high-speed agitation, whereby a dispersion stabilizer preferable for the suspension polymerization can be obtained.

In order to make these dispersion stabilizers fine-particle, 0.001 to 0.1 part by weight of a surface-active agent based on 100 parts by weight of suspension solution may be used in combination. Stated specifically, usable are commercially available nonionic, anionic or cationic surface-active agents. For example, they may include sodium dodecylsulfate, sodium tetradecylsulfate, sodium pentadecylsulfate, sodium octylsulfate, sodium oleate, sodium laurate, potassium stearate and calcium oleate.

An example of a process for producing the toner base particles by pulverization is described below. As a binder resin used in the pulverization, it may include polystyrene, poly-α-methylstyrene, a styrene-propylene copolymer, a styrene-butadiene copolymer, a styrene-vinyl chloride copolymer, a styrene-vinyl acetate copolymer, a styrene-acrylate copolymer, a styrene-methacrylate copolymer, vinyl chloride resins, polyester resins, epoxy resins, phenolic resins and polyurethane resins. Any of these may be used alone or in the form of a mixture. In particular, a styrene-acrylate copolymer, a styrene-methacrylate copolymer, and polyester resins are preferred.

Where the toner is controlled to be positively chargeable, added to the toner base particles is a product modified with a fatty acid metal salt; a quaternary ammonium salt such as tributylbenzylammonium 1-hydroxy-4-naphthosulfonate or tetrabutylammonium teterafluoroborate; a phosphonium salt of tributylbenzylphosphonium 1-hydroxy-4-naphthosulfonate or tetrabutylphosphonium teterafluoroborate; an amine or polyamine compound; a metal salt of a higher fatty acid; a diorganotin oxide such as dibutyltin oxide, dioctyltin oxide or dicyclohexyltin oxide; or a diorganotin borate such as dibutyltin borate, dioctyltin borate or dicyclohexyltin borate. Where the toner is controlled to be negatively chargeable, organic metal complexes and chelate compounds are effective, and usable are monoazo metal complexes, acetylacetone metal complexes, and metal complexes of aromatic hydroxycarboxylic acids or aromatic dicarboxylic acids. Any of these charge control agents may be used in an amount of from 0.1 to 15 parts by weight, and preferably from 0.1 to 10 parts by weight, based on 100 parts by weight of the binder resin.

A low-softening substance as a release agent may optionally be added to the toner base particles. The low-softening substance may include aliphatic hydrocarbon waxes such as low-molecular weight polyethylene, low-molecular weight polypropylene, paraffin waxes and Fischer-Tropsh waxes, or oxides thereof; waxes composed chiefly of a fatty ester, such as carnauba was and montanate wax; and those obtained by subjecting part or the whole of these to deoxidation. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol and melissyl alcohol; polyhydric alcohols such as sorbitol; fatty acid amides such as linolic acid amide; saturated fatty bisamides such as methylenebis(stearic acid amide); unsaturated fatty acid amides such as ethylenebis (oleic acid amide); aromatic bisamides such as N,N'-distearylisophthalic acid amide; fatty acid metal salts such as zinc stearate; grafted waxes obtained by grafting vinyl monomers such as styrene to aliphatic hydrocarbon waxes; partially esterified products of polyhydric alcohols with fatty acids, such as monoglyceride behenate; and methyl esterified products having a hydroxyl group, obtained by hydrogenation of vegetable fats and oils. The low-softening substance may be added in an amount of from 0.1 to 20 parts by weight, and preferably from 0.5 to 10 parts by weight, based on 100 parts by weight of the binder resin.

Next, the binder resin, the release agent, the charge control agent, the colorant and so forth are thoroughly mixed by means of a mixing machine such as Henschel mixer or a ball mill, and then the mixture obtained is melt-kneaded using a heat kneading machine such as a heating roll, a kneader or an extruder to make the resins melt one another, in which the charge control agent and the colorant are dispersed or dissolved, and the kneaded product obtained is cooled to solidify, followed by mechanical pulverization to the desired particle size and further followed by classification to make the resultant finely pulverized product have a sharp particle size distribution. Alternatively, a finely pulverized product obtained by cooling and solidifying the kneaded product and thereafter colliding the solidified product against a target in jet streams may be made spherical by thermal or mechanical impact force.

To the toner base particles thus obtained, the perovskite type crystal inorganic fine powder is externally added to made up the toner of the present invention. The perovskite type crystal inorganic fine powder may preferably be added to the toner base particles in an amount of from 0.05 to 2.00 parts by weight, and more preferably from 0.20 to 1.80 parts by weight, based on 100 parts by weight of the toner base particles. Also, in the case when the perovskite type crystal inorganic fine powder surface-treated with the fatty acid having 8 to 35 carbon atoms or a metal salt thereof is externally added, it may preferably be added in an amount of from 0.05 to 3.00 parts by weight, and more preferably from 0.20 to 2.50 parts by weight, based on 100 parts by weight of the toner base particles.

In the present invention, the following inorganic powder may further be added to the toner base particles in order to improve developing performance and running performance of the toner. For example, it may include powders of oxides of metals such as silicon, magnesium, zinc, aluminum, titanium, cerium, cobalt, iron, zirconium, chromium, manganese, tin and antimony; powders of metal salts such as barium sulfate, calcium carbonate, magnesium carbonate and aluminum carbonate; powders of clay minerals such as kaolin; powders of phosphorus compounds such as apatite; powders of silicon compounds such as silicon carbide and silicon nitride; and carbon powders such carbon black and graphite powder.

For the like purpose, the following organic particles or composite particles may be added to toner base particles. They may include resin particles such as polyamide resin particles, silicone resin particles, silicone rubber particles, urethane particles, melamine-formaldehyde particles and acrylate particles; composite particles composed of rubbers, waxes, fatty acid compounds or resins with inorganic particles of metals, metal oxides or carbon black; particles of fluorine resins such as TEFLON (trademark) and polyvinylidene fluoride; particles of fluorine compounds such as fluorocarbon; particles of fatty acid metal salts such as zinc stearate; particles of fatty acid derivatives such as fatty esters; and particles of molybdenum sulfide, amino acids and amino acid derivatives.

EXAMPLES

The present invention is described below in greater detail by giving Examples and Comparative Examples. What are expressed as "part(s)" and "%" are by weight unless particularly noted.

Perovskite Type Crystal Inorganic Fine Powder

Production Example 1

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 0.7 to obtain a titania sol dispersion. NaOH was added to this titania sol dispersion to adjust the pH of the dispersion to 5.0, and washing was repeated until the supernatant liquid came to have an electrical conductivity of 70 μS/cm.

$Sr(OH)_2.8H_2O$ was added in a 0.98-fold molar quantity based on the water-containing titanium oxide.

This was put into a reaction vessel made of SUS stainless steel, and its inside atmosphere was displaced with nitrogen gas. Distilled water was further so added as to come to 0.5 mol/liter in terms of $SrTiO_3$. In an atmosphere of nitrogen, the resultant slurry was heated to 80° C. at a rate of 7° C./hour. After it reached 80° C., the reaction was carried out for 6 hours. After the reaction, the reaction mixture was cooled to room temperature, and its supernatant liquid was removed. Thereafter, washing with pure water was repeated, followed by filtration using a suction filter. The cake obtained was dried to obtain fine strontium titanate particles having undergone no sintering step. The fine strontium titanate particles thus obtained is designated as Inorganic Fine Powder A. Physical properties of Inorganic Fine Powder A are shown in Table 1.

Perovskite Type Crystal Inorganic Fine Powder

Production Example 2

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 0.8 to obtain a titania sol dispersion. NaOH was added to this titania sol dispersion to adjust the pH of the dispersion to 5.0, and washing was repeated until the supernatant liquid came to have an electrical conductivity of 70 μS/cm.

$Sr(OH)_2.8H_2O$ was added in a 0.95-fold molar quantity based on the water-containing-titanium oxide.

This was put into a reaction vessel made of SUS stainless steel, and its inside atmosphere was displaced with nitrogen gas. Distilled water was further so added as to come to 0.7 mol/liter in terms of $SrTiO_3$. In an atmosphere of nitrogen, the resultant slurry was heated to 65° C. at a rate of 8° C./hour. After it reached 65° C., the reaction was carried out for 5 hours. After the reaction, the reaction mixture was cooled to room temperature, and its supernatant liquid was removed. Thereafter, washing with pure water was repeated, followed by filtration using a suction filter. The cake obtained was dried to obtain fine strontium titanate particles having undergone no sintering step. The fine strontium titanate particles thus obtained is designated as Inorganic Fine Powder B. Physical properties of Inorganic Fine Powder B are shown in Table 1.

Perovskite Type Crystal Inorganic Fine Powder

Production Example 3

A water-containing titanium oxide slurry obtained by hydrolysis by adding ammonia water to an aqueous titanium tetrachloride solution was washed with pure water, and, to this water-containing titanium oxide slurry, 0.3% sulfuric acid was added as $SO_3$ for the water-containing titanium oxide. Next, hydrochloric acid was added to this water-containing titanium oxide slurry to adjust its pH to 0.6 to obtain a titania sol dispersion. NaOH was added to this titania sol dispersion to adjust the pH of the dispersion to 5.0, and washing was repeated until the supernatant liquid came to have an electrical conductivity of 50 μS/cm.

$Sr(OH)_2.8H_2O$ was added in a 0.97-fold molar quantity based on the water-containing titanium oxide. This was put into a reaction vessel made of SUS stainless steel, and its inside atmosphere was displaced with nitrogen gas. Distilled water was further so added as to come to 0.6 mol/liter in terms of $SrTiO_3$. In an atmosphere of nitrogen, the resultant slurry was heated to 60° C. at a rate of 10° C./hour. After it reached 60° C., the reaction was carried out for 7 hours. After the reaction, the reaction mixture was cooled to room temperature, and its supernatant liquid was removed. Thereafter, washing with pure water was repeated, followed by filtration using a suction filter. The cake obtained was dried to obtain fine strontium titanate particles having undergone no sintering step. The fine strontium titanate particles thus obtained is designated as Inorganic Fine Powder C. Physical properties of Inorganic Fine Powder C are shown in Table 1.

Perovskite Type Crystal Inorganic Fine Powder

Production Example 4

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 0.65 to obtain a titania sol dispersion. NaOH was added to this titania sol dispersion to adjust the pH of the dispersion to 4.5, and washing was repeated until the supernatant liquid came to have an electrical conductivity of 70 μS/cm.

$Sr(OH)_2.8H_2O$ was added in a 0.97-fold molar quantity based on the water-containing titanium oxide. This was put into a reaction vessel made of SUS stainless steel, and its inside atmosphere was displaced with nitrogen gas. Distilled water was further so added as to come to 0.5 mol/liter in terms of $SrTiO_3$.

In an atmosphere of nitrogen, the resultant slurry was heated to 83° C. at a rate of 6.5° C./hour. After it reached 83° C., the reaction was carried out for 6 hours. After the reaction, the reaction mixture was cooled to room temperature, and its supernatant liquid was removed. Thereafter, washing with pure water was repeated.

In an atmosphere of nitrogen, the above slurry was further put into an aqueous solution in which sodium stearate (number of carbon atoms: 18) was dissolved in an amount of 6.5% by weight based on the solid matter of the slurry, and an aqueous zinc sulfate solution was dropwise added thereto with stirring to make zinc stearate deposited on the surfaces of perovskite type crystals.

This slurry was repeatedly washed with pure water, followed by filtration using a suction filter. The cake obtained was dried to obtain fine strontium titanate particles surface-treated with zinc stearate. The surface-treated fine strontium titanate particles thus obtained, having undergone no sintering step, is designated as Inorganic Fine Powder D. Physical properties of Inorganic Fine Powder D are shown in Table 1. A photograph of this Inorganic Fine Powder D which was taken at 50,000 magnifications on an electron microscope is shown in FIG. 1. Fine particles looking rectangular or cubic are the fine strontium titanate particles surface-treated with zinc stearate.

Perovskite Type Crystal Inorganic Fine Powder

Production Example 5

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 0.7 to obtain a titania sol dispersion. NaOH was added to this titania sol dispersion to adjust the pH of the dispersion to 5.3, and washing was repeated until the supernatant liquid came to have an electrical conductivity of 70 μS/cm.

$Sr(OH)_2.8H_2O$ was added in a 0.93-fold molar quantity based on the water-containing titanium oxide. This was put into a reaction vessel made of SUS stainless steel, and its inside atmosphere was displaced with nitrogen gas. Distilled water was further so added as to come to 0.7 mol/liter in terms of $SrTiO_3$.

In an atmosphere of nitrogen, the resultant slurry was heated to 70° C. at a rate of 8.5° C./hour. After it reached 70° C., the reaction was carried out for 5 hours. After the reaction, the reaction mixture was cooled to room temperature, and its supernatant liquid was removed. Thereafter, washing with pure water was repeated.

In an atmosphere of nitrogen, the above slurry was further put into an aqueous solution in which sodium stearate was dissolved in an amount of 3% by weight based on the solid matter of the slurry, and an aqueous calcium sulfate solution was dropwise added thereto with stirring to make calcium stearate deposited on the surfaces of perovskite type crystals.

This slurry was repeatedly washed with pure water, followed by filtration using a suction filter. The cake obtained was dried to obtain fine strontium titanate particles surface-treated with calcium stearate. The surface-treated fine strontium titanate particles thus obtained, having undergone no sintering step, is designated as Inorganic Fine Powder E. Physical properties of Inorganic Fine Powder E are shown in Table 1.

Perovskite Type Crystal Inorganic Fine Powder

Production Example 6

A water-containing titanium oxide slurry obtained by hydrolysis by adding ammonia water to an aqueous titanium tetrachloride solution was washed with pure water, and, to this water-containing titanium oxide slurry, 0.25% sulfuric acid was added as $SO_3$ for the water-containing titanium. Next, hydrochloric acid was added to this water-containing titanium oxide slurry to adjust its pH to 0.65 to obtain a titania sol dispersion. NaOH was added to this titania sol dispersion to adjust the pH of the dispersion to 4.7, and washing was repeated until the supernatant liquid came to have an electrical conductivity of 50 μS/cm.

$Sr(OH)_2.8H_2O$ was added in a 0.95-fold molar quantity based on the water-containing titanium oxide. This was put into a reaction vessel made of SUS stainless steel, and its inside atmosphere was displaced with nitrogen gas. Distilled water was further so added as to come to 0.6 mol/liter in terms of $SrTiO_3$.

In an atmosphere of nitrogen, the resultant slurry was heated to 65° C. at a rate of 10° C./hour. After it reached 65° C., the reaction was carried out for 8 hours. After the reaction, the reaction mixture was cooled to room temperature, and its supernatant liquid was removed. Thereafter, washing with pure water was repeated.

In an atmosphere of nitrogen, the above slurry was further put into an aqueous solution in which sodium stearate was dissolved in an amount of 2% by weight based on the solid matter of the slurry, and an aqueous magnesium sulfate solution was dropwise added thereto with stirring to make magnesium stearate deposited on the surfaces of perovskite type crystals.

This slurry was repeatedly washed with pure water, followed by filtration using a suction filter. The cake obtained was dried to obtain fine strontium titanate particles surface-treated with magnesium stearate. The surface-treated fine strontium titanate particles thus obtained, having undergone no sintering step, is designated as Inorganic Fine Powder F. Physical properties of Inorganic Fine Powder F are shown in Table 1.

Perovskite Type Crystal Inorganic Fine Powder

Production Example 7

Surface-treated fine strontium titanate particles having undergone no sintering step was obtained in the same manner as in Perovskite Type Crystal Inorganic Fine Powder Production Example 6 except that the surface treatment was carried out using 13% by weight of zinc montanate (number of carbon atoms: 29). The fine strontium titanate particles thus obtained is designated as Inorganic Fine Powder G. Physical properties of Inorganic Fine Powder G are shown in Table 1.

Perovskite Type Crystal Inorganic Fine Powder

Production Example 8

Surface-treated fine strontium titanate particles having undergone no sintering step was obtained in the same manner as in Perovskite Type Crystal Inorganic Fine Powder Production Example 6 except that the surface treatment was carried out using 2% by weight of aluminum laurate (number of carbon atoms: 12). The fine strontium titanate particles thus obtained is designated as Inorganic Fine Powder H. Physical properties of Inorganic Fine Powder H are shown in Table 1.

Perovskite Type Crystal Inorganic Fine Powder

Production Example 9

Surface-treated fine strontium titanate particles having undergone no sintering step was obtained in the same manner as in Perovskite Type Crystal Inorganic Fine Powder Production Example 6 except that the surface treatment was carried out using 2% by weight of aluminum sorbate (number of carbon atoms: 6). The fine strontium titanate particles thus obtained is designated as Inorganic Fine Powder I. Physical properties of Inorganic Fine Powder I are shown in Table 1.

Perovskite Type Crystal Inorganic Fine Powder

Production Example 10

Surface-treated fine strontium titanate particles having undergone no sintering step was obtained in the same manner as in Perovskite Type Crystal Inorganic Fine Powder Production Example 6 except that the surface treatment was carried out using 2% by weight of aluminum n-octatriacontanate (number of carbon atoms: 38). The fine strontium titanate particles thus obtained is designated as Inorganic Fine Powder J. Physical properties of Inorganic Fine Powder J are shown in Table 1.

Perovskite Type Crystal Inorganic Fine Powder

Production Example 11

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 0.65 to obtain a titania sol dispersion. NaOH was added to this titania sol dispersion to adjust the pH of the dispersion to 4.5, and washing was repeated until the supernatant liquid came to have an electrical conductivity of 70 μS/cm.

$Sr(OH)_2.8H_2O$ was added in a 0.97-fold molar quantity based on the water-containing titanium oxide. This was put into a reaction vessel made of SUS stainless steel, and its inside atmosphere was displaced with nitrogen gas. Distilled water was further so added as to come to 0.5 mol/liter in terms of $SrTiO_3$.

In an atmosphere of nitrogen, the resultant slurry was heated to 83° C. at a rate of 6.5° C./hour. After it reached 83° C., the reaction was carried out for 6 hours. After the reaction, the reaction mixture was cooled to room temperature, and its supernatant liquid was removed. Thereafter, washing with pure water was repeated.

100 parts of the strontium titanate was further put into a closed high-speed stirrer to carry out stirring making displacement with nitrogen. A treating agent prepared by diluting 5 parts of dimethylsilicone oil 6.5 times with hexane was sprayed into the stirrer. After the treating agent was all sprayed, the inside of the stirrer was heated to 350° C. with stirring, where the stirring was carried out for 3 hours. The temperature inside the stirrer was returned to room temperature with stirring, and its contents were taken out, followed by disintegration treatment by means of a pin mill to obtain fine strontium titanate particles surface-treated with dimethylsilicone oil. The surface-treated fine strontium titanate particles thus obtained, having undergone no sintering step, is designated as Inorganic Fine Powder K. Physical properties of Inorganic Fine Powder K are shown in Table 1.

Perovskite Type Crystal Inorganic Fine Powder

Production Example 12

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 0.65 to obtain a titania sol dispersion. NaOH was added to this titania sol dispersion to adjust the pH of the dispersion to 4.5, and washing was repeated until the supernatant liquid came to have an electrical conductivity of 70 μS/cm.

$Sr(OH)_2.8H_2O$ was added in a 0.97-fold molar quantity based on the water-containing titanium oxide. This was put into a reaction vessel made of SUS stainless steel, and its inside atmosphere was displaced with nitrogen gas. Distilled water was further so added as to come to 0.5 mol/liter in terms of $SrTiO_3$.

In an atmosphere of nitrogen, the resultant slurry was heated to 83° C. at a rate of 6.5° C./hour. After it reached 83° C., the reaction was carried out for 6 hours. After the reaction, the reaction mixture was cooled to room temperature, and its supernatant liquid was removed. Thereafter, washing with pure water was repeated.

100 parts of the strontium titanate was further put into a closed high-speed stirrer to carry out stirring making displacement with nitrogen. A treating agent prepared by diluting 10 parts of isopropoxytitanium tristearate 8 times with isopropyl alcohol was sprayed into the stirrer. After the treating agent was all sprayed, the inside of the stirrer was heated to 45° C. with stirring, where the stirring was carried out for 1 hour. The temperature inside the stirrer was returned to room temperature with stirring, and its contents were taken out, followed by disintegration treatment by means of a pin mill to obtain fine strontium titanate particles surface-treated with isopropoxytitanium tristearate. The surface-treated fine strontium titanate particles thus obtained, having undergone no sintering step, is designated as Inorganic Fine Powder L. Physical properties of Inorganic Fine Powder L are shown in Table 1.

Perovskite Type Crystal Inorganic Fine Powder

Comparative Production Example 1

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 4.0 to obtain a titania sol dispersion. NaOH was added to this titania sol dispersion to adjust the pH of the dispersion to 8.0, and washing was repeated until the supernatant liquid came to have an electrical conductivity of 100 μS/cm.

$Sr(OH)_2.8H_2O$ was added in a 1.02-fold molar quantity based on the water-containing titanium oxide. This was put into a reaction vessel made of SUS stainless steel, and its inside atmosphere was displaced with nitrogen gas. Distilled water was further so added as to come to 0.3 mol/liter in terms of $SrTiO_3$. In an atmosphere of nitrogen, the resultant slurry was heated to 90° C. at a rate of 30° C./hour. After it reached 90° C., the reaction was carried out for 5 hours. After the reaction, the reaction mixture was cooled to room temperature, and its supernatant liquid was removed. Thereafter, washing with pure water was repeated, followed by filtration using a suction filter. The cake obtained was dried to obtain fine strontium titanate particles having a primary-particle average particle diameter of 25 nm. The fine strontium titanate particles thus obtained is designated as Comparative Inorganic Fine Powder A. Physical properties of Comparative Inorganic Fine Powder A are shown in Table 1.

Perovskite Type Crystal Inorganic Fine Powder

Comparative Production Example 2

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 1.0 to obtain a titania sol dispersion. NaOH was added to this titania sol dispersion to adjust the pH of the dispersion to 5.0, and washing was repeated until the supernatant liquid came to have an electrical conductivity of 100 μS/cm.

$Sr(OH)_2.8H_2O$ was added in a 1.02-fold molar quantity based on the water-containing titanium oxide. This was put into a reaction vessel made of SUS stainless steel, and its inside atmosphere was displaced with nitrogen gas. Distilled water was further so added as to come to 0.3 mol/liter in terms of $SrTiO_3$. In an atmosphere of nitrogen, the resultant slurry was heated to 90° C. at a rate of 70° C./hour. After it reached 90° C., the reaction was carried out for 5 hours. After the reaction, the reaction mixture was cooled to room temperature, and its supernatant liquid was removed. Thereafter, washing with pure water was repeated, followed by filtration using a suction filter. The cake obtained was dried to obtain fine strontium titanate particles having a primary-particle average particle diameter of 310 nm. The fine strontium titanate particles thus obtained is designated as Comparative Inorganic Fine Powder B. Physical properties of Comparative Inorganic Fine Powder B are shown in Table 1.

Perovskite Type Crystal Inorganic Fine Powder

Comparative Production Example 3

A water-containing titanium oxide obtained by hydrolysis by adding ammonia water to an aqueous titanium tetrachloride solution was washed with pure water until the supernatant liquid came to have an electrical conductivity of 90 μS/cm.

$Sr(OH)_2.8H_2O$ was added in a 1.5-fold molar quantity based on the water-containing titanium oxide. This was put into a reaction vessel made of SUS stainless steel, and its inside atmosphere was displaced with nitrogen gas. Distilled water was further so added as to come to 0.2 mol/liter in terms of $SrTiO_3$. In an atmosphere of nitrogen, the resultant slurry was heated to 90° C. at a rate of 10° C./hour. After it reached 90° C., the reaction was carried out for 7 hours. After the reaction, the reaction mixture was cooled to room temperature, and its supernatant liquid was removed. Thereafter, washing with pure water was repeated, followed by filtration using a suction filter. The cake obtained was dried to obtain fine strontium titanate particles having 8% by number in total of particles and agglomerates of 600 nm or more in diameter. The fine strontium titanate particles thus obtained is designated as Comparative Inorganic Fine Powder C. Physical properties of Comparative Inorganic Fine Powder C are shown in Table 1.

Perovskite Type Crystal Inorganic Fine Powder

Comparative Production Example 4

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 4.3 to obtain a titania sol dispersion. NaOH was added to this titania sol dispersion to adjust the pH of the dispersion to 8.0, and washing was repeated until the supernatant liquid came to have an electrical conductivity of 100 μS/cm.

$Sr(OH)_2.8H_2O$ was added in a 1.05-fold molar quantity based on the water-containing titanium oxide. This was put into a reaction vessel made of SUS stainless steel, and its inside atmosphere was displaced with nitrogen gas. Distilled water was further so added as to come to 0.3 mol/liter in terms of $SrTiO_3$.

In an atmosphere of nitrogen, the resultant slurry was heated to 95° C. at a rate of 25° C./hour. After it reached 95° C., the reaction was carried out for 5 hours. After the reaction, the reaction mixture was cooled to room temperature, and its supernatant liquid was removed. Thereafter, washing with pure water was repeated.

In an atmosphere of nitrogen, the above slurry was further put into an aqueous solution in which sodium stearate was dissolved in an amount of 2% by weight based on the solid matter of the slurry, and an aqueous zinc sulfate solution was dropwise added thereto with stirring to make zinc stearate deposited on the surfaces of perovskite type crystals.

This slurry was repeatedly washed with pure water, followed by filtration using a suction filter. The cake obtained was dried to obtain fine strontium titanate particles surface-treated with zinc stearate. The surface-treated fine strontium titanate particles thus obtained, having a primary-particle average particle diameter of 25 nm, is designated as Comparative Inorganic Fine Powder D. Physical properties of Comparative Inorganic Fine Powder D are shown in Table 1.

Perovskite Type Crystal Inorganic Fine Powder

Comparative Production Example 5

A water-containing titanium oxide slurry obtained by hydrolysis of an aqueous titanyl sulfate solution was washed with an aqueous alkali solution. Next, hydrochloric acid was added to this water-containing titanium oxide slurry to adjust its pH to 1.5 to obtain a titania sol dispersion. NaOH was added to this titania sol dispersion to adjust the pH of the dispersion to 5.3, and washing was repeated until the supernatant liquid came to have an electrical conductivity of 100 μS/cm.

$Sr(OH)_2.8H_2O$ was added in a 1.07-fold molar quantity based on the water-containing titanium oxide. This was put into a reaction vessel made of SUS stainless steel, and its inside atmosphere was displaced with nitrogen gas. Distilled water was further so added as to come to 0.3 mol/liter in terms of $SrTiO_3$.

In an atmosphere of nitrogen, the resultant slurry was heated to 87° C. at a rate of 70° C./hour. After it reached 87° C., the reaction was carried out for 5 hours. After the reaction, the reaction mixture was cooled to room temperature, and its supernatant liquid was removed. Thereafter, washing with pure water was repeated.

In an atmosphere of nitrogen, the above slurry was further put into an aqueous solution in which sodium stearate was dissolved in an amount of 1% by weight based on the solid matter of the slurry, and an aqueous zinc sulfate solution was dropwise added thereto with stirring to make zinc stearate deposited on the surfaces of perovskite type crystals.

This slurry was repeatedly washed with pure water, followed by filtration using a suction filter. The cake obtained was dried to obtain fine strontium titanate particles surface-treated with zinc stearate. The surface-treated fine strontium titanate particles thus obtained, having a primary-particle average particle diameter of 320 nm, is designated as Comparative Inorganic Fine Powder E. Physical properties of Comparative Inorganic Fine Powder E are shown in Table 1.

Perovskite Type Crystal Inorganic Fine Powder

Comparative Production Example 6

A water-containing titanium oxide obtained by hydrolysis by adding ammonia water to an aqueous titanium tetrachloride solution was washed with pure water until the supernatant liquid came to have an electrical conductivity of 90 μS/cm.

$Sr(OH)_2.8H_2O$ was added in a 1.5-fold molar quantity based on the water-containing titanium oxide. This was put into a reaction vessel made of SUS stainless steel, and its inside atmosphere was displaced with nitrogen gas. Distilled water was further so added as to come to 0.2 mol/liter in terms of $SrTiO_3$.

In an atmosphere of nitrogen, the resultant slurry was heated to 80° C. at a rate of 15° C./hour. After it reached 80° C., the reaction was carried out for 5 hours. After the reaction, the reaction mixture was cooled to room temperature, and its supernatant liquid was removed. Thereafter, washing with pure water was repeated.

In an atmosphere of nitrogen, the above slurry was further put into an aqueous solution in which sodium stearate was dissolved in an amount of 18% by weight based on the solid matter of the slurry, and an aqueous zinc sulfate solution was dropwise added thereto with stirring to make zinc stearate deposited on the surfaces of perovskite type crystals.

This slurry was repeatedly washed with pure water, followed by filtration using a suction filter. The cake obtained was dried to obtain fine strontium titanate particles surface-treated with zinc stearate. The surface-treated fine strontium titanate particles thus obtained, having a primary-particle average particle diameter of 350 nm, is designated as Comparative Inorganic Fine Powder F. Physical properties of Comparative Inorganic Fine Powder F are shown in Table 1.

Perovskite Type Crystal Inorganic Fine Powder

Comparative Production Example 7

Inorganic Fine Powder B was sintered at 1,000° C., followed by disintegration to obtain fine strontium titanate particles having undergone a sintering step.

Figure 2:
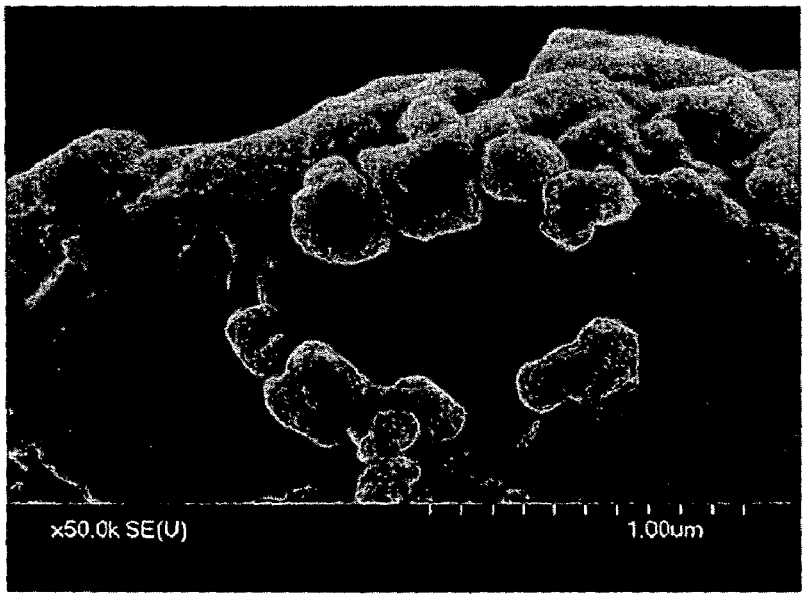
FIG. 2 is a view showing an image made up by drawing an electron microscope photograph (magnification: 50,000) of Comparative Inorganic Fine Powder G shown in Comparative Production Example 7 of a perovskite type crystal inorganic fine powder.

This fine strontium titanate particles, having a primary-particle average particle diameter of 430 nm and having an amorphous particle shape, is designated as Comparative Inorganic Fine Powder G. Physical properties of Comparative Inorganic Fine Powder G are shown in Table 1. A photograph of this Comparative Inorganic Fine Powder G which was taken at 50,000 magnifications on an electron microscope is shown in FIG. 2. Amorphous fine strontium titanate particles of 200 nm to 400 nm in diameter are seen in FIG. 2.

Perovskite Type Crystal Inorganic Fine Powder

Comparative Production Example 8

Figure 3:
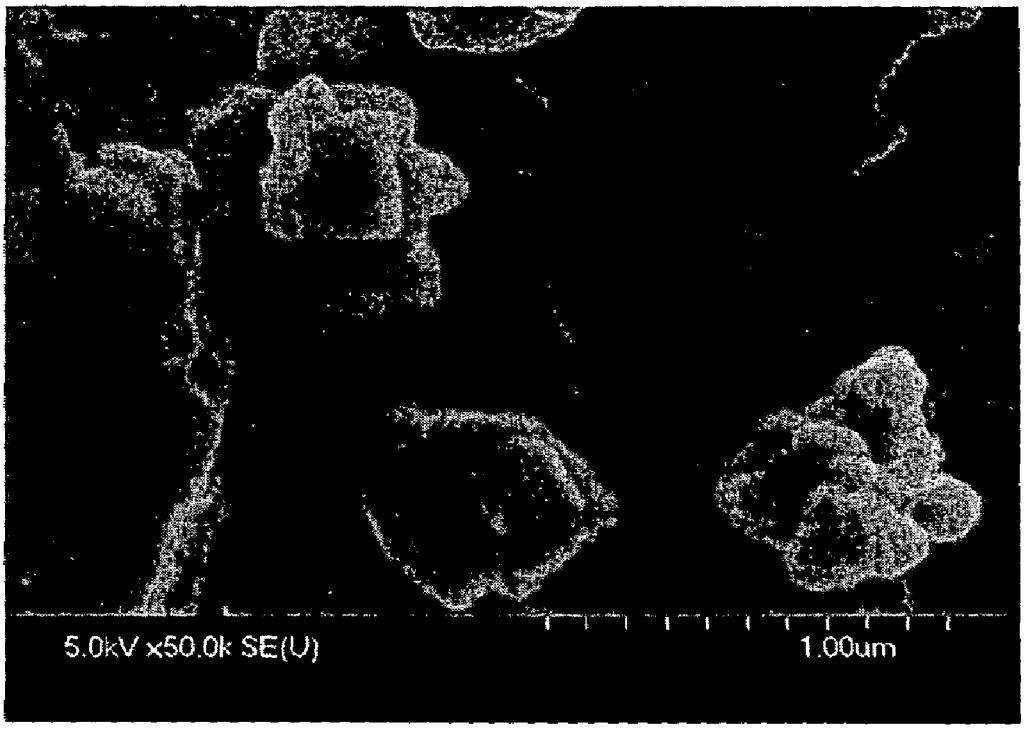
FIG. 3 is a view showing an image made up by drawing an electron microscope photograph (magnification: 50,000) of Comparative Inorganic Fine Powder H shown in Comparative Production Example 8 of a perovskite type crystal inorganic fine powder.

600 g of strontium carbonate and 350 g of titanium oxide were mixed by a wet process for 8 hours using a ball mill, followed by filtration and then drying. The mixture obtained was molded under a pressure of 10 kg/cm$^2$, and the molded product obtained was sintered at 1,200° C. for 7 hours. The resultant sintered product was mechanically pulverized to obtain fine strontium titanate particles having a primary-particle average particle diameter of 700 nm, having undergone a sintering step. This fine strontium titanate particles is designated as Comparative Inorganic Fine Powder H. Physical properties of Comparative Inorganic Fine Powder H are shown in Table 1. A photograph of this Comparative Inorganic Fine Powder H which was taken at 50,000 magnifications on an electron microscope is shown in FIG. 3. Amorphous fine strontium titanate particles of 700 nm to 800 nm in diameter are seen in FIG. 3.

Perovskite Type Crystal Inorganic Fine Powder

Comparative Production Example 9

In 300 ml of an aqueous 100 g/l titanium chloride ($TiCl_4$) solution, strontium carbonate ($SrCO_3$) in an equivalent weight to Ti was dissolved. In an atmosphere of nitrogen, potassium hydroxide (KOH) in an equivalent weight to chloride ions in the solution was added and these were heated for 3 hours with stirring at 150° C. in an autoclave. The product was filtered, washed and then dried to obtain fine strontium titanate particles having 1.8% by number in total of particles and agglomerates of 600 nm or more in diameter. The fine strontium titanate particles thus obtained is designated as Comparative Inorganic Fine Powder I. Physical properties of Comparative Inorganic Fine Powder I are shown in Table 1.

TABLE 1

| Sample No. | Primary = particle average particle diameter (nm) | Content of 600 nm or larger particles and agglomerates (no. %) | Particle shape | Content of cubic, cubic-like, rectangular and/or rectangle-like particles (no. %) | Specific surface area (m$^2$/g) | Contact angle (°) | Charge quantity (mC/Kg) |
|---|---|---|---|---|---|---|---|
| | | | Inorganic Fine Powder: | | | | |
| A | 100 | 0.6 | (a) | 80 | 48 | 20 | −15 |
| B | 190 | 0.4 | (a) | 55 | 29 | 18 | −8 |
| C | 35 | 0.7 | (a) | 45 | 51 | 21 | −36 |
| D | 100 | 0.5 | (a) | 80 | 15 | 150 | 32 |
| E | 190 | 0.8 | (a) | 55 | 10 | 105 | 25 |
| F | 60 | 0.4 | (a) | 45 | 48 | 122 | 13 |
| G | 60 | 0.4 | (a) | 45 | 47 | 135 | 85 |
| H | 60 | 0.4 | (a) | 45 | 48 | 98 | 8 |
| I | 60 | 0.4 | (a) | 45 | 45 | 85 | 5 |
| J | 60 | 0.4 | (a) | 45 | 46 | 152 | 93 |
| K | 100 | 0.6 | (a) | 80 | 17 | 130 | −165 |
| L | 100 | 0.6 | (a) | 80 | 20 | 117 | −75 |
| | | | Comparative Inorganic Fine Powder: | | | | |
| A | 25 | 0.5 | (a) | 40 | 54 | 21 | −53 |
| B | 310 | 0.8 | (a) | 40 | 21 | 17 | −2 |
| C | 100 | 8 | (a) | 40 | 46 | 19 | −6 |
| D | 25 | 0.3 | (a) | 53 | 60 | 100 | 40 |
| E | 320 | 0.9 | (a) | 48 | 8 | 73 | 20 |
| F | 350 | 2.5 | (a) | 48 | 5 | 128 | 105 |
| G | 430 | 23 | Amorphous | 0 | 18 | 18 | −3 |
| H | 700 | 75 | Amorphous | 0 | 2 | 17 | 2 |
| I | 260 | 1.8 | Spherical | 0 | 22 | 18 | 5 |

(a) Cubic, cube-like, rectangular and/or rectangle-like

Toner Base Particles

Production Example 1

Into a 2-L four-necked flask having a high-speed stirrer CLEARMIX (manufactured by M. Technique K. K.), 630 parts of ion-exchanged water and 485 parts of an aqueous 0.1 mol/L $Na_3PO_4$ solution were introduced, and these were heated to 65° C. changing the number of revolutions of CLEAMIX to 14,000 rpm. To the resultant mixture, 65 parts of an aqueous 1.0 mol/L $CaCl_2$ solution was little by little added, and 10% hydrochloric acid was further added to obtain an aqueous dispersion medium with a pH of 5.8, containing fine sparingly water-soluble dispersant $Ca_3(PO_4)_2$.

| | |
|---|---|
| Styrene monomer | 180 parts |
| n-Butyl acrylate | 20 parts |
| Carbon black | 25 parts |
| 3,5-Di-t-butylsalicylic acid aluminum compound | 1.3 parts |

The above materials were dispersed for 5 hours by means of an attritor to prepare a mixture. Thereafter, to the mixture, the following components were added, and these were further dispersed for 2 hours to prepare a monomer mixture.

| | |
|---|---|
| Saturated polyester resin | 12 parts |

(monomer composition: a condensation product of propylene oxide modified bisphenol A with terephthalic acid; acid value: 8.8 mg·KOH/g; peak molecular weight: 12,500; weight-average molecular weight: 19,500)

| | |
|---|---|
| Ester wax | 20 parts |

(composition: behenyl behenate; molecular weight: 11,500)

Next, to the monomer mixture, 5 parts of a polymerization initiator 2,2'-azobis(2,4-dimethylvaleronitrile) was added to prepare a polymerizable monomer composition, which was thereafter introduced into the aqueous dispersion medium, followed by granulation for 15 minutes at 70° C. in an atmosphere of nitrogen and at 15,000 rpm. Thereafter, the stirrer was changed for a propeller stirrer, and polymerization was carried out for 5 hours with stirring at 50 rpm at a temperature kept to 70° C. The internal temperature was further raised to 80° C., where the reaction was carried out for 5 hours. After the polymerization reaction was completed, the slurry formed was cooled, and diluted hydrochloric acid was added thereto to dissolve the dispersant. This was further washed with water and then dried, followed by classification to obtain Toner Base Particles A.

Toner Base Particles

Production Example 2

| | |
|---|---|
| Styrene-n-butyl acrylate copolymer (copolymerization weight ratio: 78:22; weight-average molecular weight: 380,000) | 100 parts |

-continued

| | |
|---|---|
| Carbon black | 8 parts |
| 3,5-Di-t-butylsalicylic acid aluminum compound | 5 parts |
| Paraffin wax (weight-average molecular weight: 900) | 2 parts |

A compound of the above materials was mixed using a HENSCHEL MIXER, and the mixture obtained was melt-kneaded by means of a twin-screw extruder. Thereafter, the kneaded product obtained was crushed by means of a hammer mill, and the crushed product obtained was finely pulverized by means of a jet mill, followed by classification to obtain Toner Base Particles B.

Example 1

To 100 parts of Toner Base Particles A, 1.2 parts of hydrophobic fine silica particles (BET specific surface area: 85 $m^2/g$) obtained by surface-treating 100 parts of fine silica powder of 20 nm in primary particle diameter with 7 parts of hexamethyldisilazane, and 0.9 part of Inorganic Fine Powder A were externally added by means of a HENSCHEL MIXER (FM10B) (number of revolutions: 66 revolutions/second; time: 3 minutes) to obtain Toner A. Toner A had a weight-average particle diameter of 6.8 μm. The liberation percentage of Inorganic Fine Powder A was 8% by volume.

Evaluation

Figure 5:
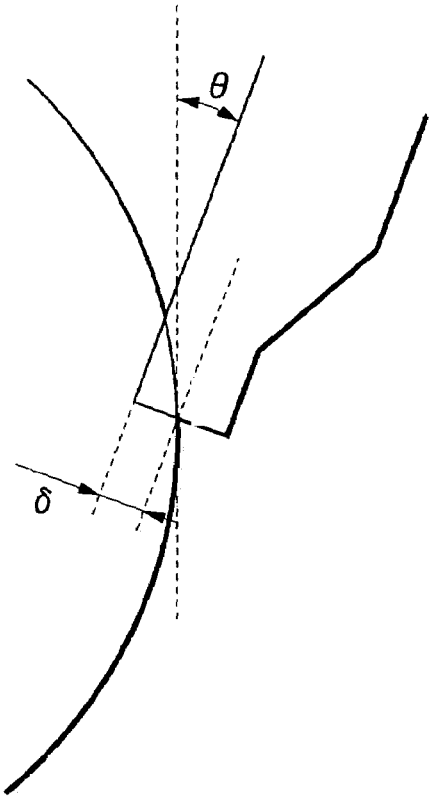
FIG. 5 is a view showing a penetration level, and a preset angle, of a cleaning blade.

The toner obtained as described above was evaluated according to the following evaluation modes, setting conditions of a cleaning blade of a commercially available color laser printer LBP2160 (manufactured by CANON INC.) to a penetration level δ of 1.1 mm and a preset angle θ of 22°. The penetration level δ and the preset angle θ are shown in FIG. 5.

Evaluation Mode 1:

A yellow cartridge of the evaluation machine was filled with 300 g of Toner A, and two-sheet intermittent printing was performed on 5,000 sheets at a print percentage of 4%. Solid black images and solid white images were sampled to evaluate the respective images. The surface of an electrostatic latent image bearing member (OPC photosensitive drum) was observed to examine whether or not it had scratches. Evaluation was made separately in three environments, an environment of temperature 20° C./humidity 5% RH, an environment of temperature 23° C./humidity 60% RH and an environment of temperature 30° C./humidity 85% RH. Continuous printing was further performed on 5,000 sheets at a print percentage of 10% in an environment of temperature 32.5° C./humidity 90% RH to make evaluation in the same way (sampling of solid black images and solid white images).

Evaluation Mode 2:

Using the evaluation machine, in the state its intermediate transfer drum was kept released from the latent image bearing member, a charge bias was applied, during which only the OPC photosensitive drum was rotated for 30 minutes and thereafter stopped. In the state as it was, it was left for 24 hours. Thereafter, the developing assemblies and the intermediate transfer drum were returned to usual setting. Using a cartridge filled with 300 g of Toner A, a character pattern with a print percentage of 4% was continuously printed until smeared images disappeared. Evaluation was made separately in three environments, an environment of temperature 20° C./humidity 5% RH, an environment of temperature 23° C./humidity 60% RH and an environment of temperature 30° C./humidity 85% RH.

Evaluation Mode 3:

A yellow cartridge of the evaluation machine was filled with 300 g of Toner A, and two-sheet intermittent printing was performed on 5,000 sheets at a print percentage of 35%. When the toner ran short, the cartridge was changed for a cartridge filled with Toner A, and the drum cartridges were kept as they were., where printing was performed on 5,000 sheets, and then stopped. Evaluation was made separately in three environments, an environment of temperature 20° C./humidity 5% RH, an environment of temperature 23° C./humidity 60% RH and an environment of temperature 32.5° C./humidity 90% RH. Further, the atmosphere of each environment was set to an environment of temperature 32.5° C./humidity 90% RH, and, in the state the developing assemblies and the intermediate transfer drum were kept released from the latent image bearing member, a charge bias was applied, during which only the OPC photosensitive drum was rotated for 30 minutes and thereafter stopped. In the state as it was, it was left for 24 hours. The developing assemblies and the intermediate transfer drum were returned to usual setting. Using a cartridge filled with 300 g of Toner A, a character pattern with a print percentage of 4% was continuously printed until smeared images disappeared.

Evaluation Methods (1) Image Density (Evaluation Mode 1):

On a sample of a solid black pattern, its densities at the part of 3 cm from the paper leading end were measured at three spots, the middle and both ends, to find their average value. The densities were measured with a reflection densitometer RD918 (manufactured by Macbeth Co.). The ranking of evaluation is as follows. The results of evaluation are shown in Table 2 below.

A: Density is 1.45 or more.

B: Density is 1.40 or more to less than 1.45.

C: Density is 1.35 or more to less than 1.40.

D: Density is less than 1.35.

(2) Fog (Evaluation Mode 1):

The reflectance of a sample of a solid white pattern and that of virgin paper were each measured with TC-6DS (manufactured by Tokyo Denshoku K.K.) (average at three spots), and their difference was found. The ranking of evaluation is as follows. The results of evaluation are shown in Table 2 below.

A: Less than 0.5%.

B: 0.5% or more to less than 1.0%.

C: 1.0% or more to less than 1.5%.

D: 1.5% or more.

(3) Smeared Images (Evaluation Modes 2 And 3):

Ranked in the following way in accordance with the number of sheets on which the smeared images came not to be seen. The results of evaluation are shown in Table 2 below.

A: Within 3 sheets.

B: From 4 sheets to within 10 sheets.

C: From 11 sheets to within 20 sheets.

D: From 21 sheets to within 30 sheets.

E: 31 sheets or more.

Example 2

Toner B was obtained in the same manner as in Example 1 except that Inorganic Fine Powder B was used. Toner B had a weight-average particle diameter of 6.8 μm. The liberation percentage of Inorganic Fine Powder B was 23% by volume. Toner B was evaluated in the same manner as in Example 1. The results of evaluation are shown in Table 2.

Example 3

Toner C was obtained in the same manner as in Example 1 except that Inorganic Fine Powder C was used. Toner C had a weight-average particle diameter of 6.8 μm. The liberation percentage of Inorganic Fine Powder C was 4% by volume. Toner C was evaluated in the same manner as in Example 1. The results of evaluation are shown in Table 2.

Example 4

Toner D was obtained in the same manner as in Example 1 except that Toner Base Particles B were used. Toner D had a weight-average particle diameter of 7.0 μm. The liberation percentage of Inorganic Fine Powder A was 7% by volume. Toner D was evaluated in the same manner as in Example 1. The results of evaluation are shown in Table 2.

Example 5

Toner E was obtained in the same manner as in Example 1 except that the conditions for external addition were changed to conditions of a number of revolutions of 45 revolutions/second for a time of 3 minutes. Toner E had a weight-average particle diameter of 6.8 μm. The liberation percentage of Inorganic Fine Powder A was 25% by volume. Toner E was evaluated in the same manner as in Example 1. The results of evaluation are shown in Table 2.

Example 6

To 100 parts of Toner Base Particles A, 1.2 parts of hydrophobic fine silica particles (BET specific surface area: 220 $m^2/g$) obtained by surface-treating 100 parts of fine silica powder with 20 parts of dimethylsilicone oil, and 1 part of Inorganic Fine Powder D were externally added by means of Henschel mixer (FM10B) (number of revolutions of blades: 66 revolutions/second; time: 3 minutes) to obtain Toner F. Toner F had a weight-average particle diameter of 6.8 μm. The liberation percentage of Inorganic Fine Powder D was 5% by volume. Toner F was evaluated in the same manner as in Example 1. The results of evaluation are shown in Table 2.

Example 7

Toner G was obtained in the same manner as in Example 6 except that Inorganic Fine Powder E was used. Toner G had a weight-average particle diameter of 6.8 μm. The liberation percentage of Inorganic Fine Powder E was 18% by volume. Toner G was evaluated in the same manner as in Example 1. The results of evaluation are shown in Table 2.

Example 8

Toner H was obtained in the same manner as in Example 6 except that Inorganic Fine Powder F was used. Toner H had a weight-average particle diameter of 6.8 μm. The liberation percentage of Inorganic Fine Powder F was 6% by volume. Toner H was evaluated in the same manner as in Example 1. The results of evaluation are shown in Table 2.

Example 9

Toner I was obtained in the same manner as in Example 6 except that Inorganic Fine Powder G was used. Toner I had a weight-average particle diameter of 6.8 μm. The liberation percentage of Inorganic Fine Powder G was 3% by volume. Toner I was evaluated in the same manner as in Example 1. The results of evaluation are shown in Table 2.

Example 10

Toner J was obtained in the same manner as in Example 6 except that Inorganic Fine Powder H was used. Toner J had a weight-average particle diameter of 6.8 μm. The liberation percentage of Inorganic Fine Powder H was 11% by volume. Toner J was evaluated in the same manner as in Example 1. The results of evaluation are shown in Table 2.

Example 11

Toner K was obtained in the same manner as in Example 6 except that Toner Base Particles B were used. Toner K had a weight-average particle diameter of 7.0 μm. The liberation percentage of Inorganic Fine Powder A was 5% by volume. Toner K was evaluated in the same manner as in Example 1. The results of evaluation are shown in Table 2.

Example 12

Toner L was obtained in the same manner as in Example 6 except that Inorganic Fine Powder I was used. Toner L had a weight-average particle diameter of 6.8 μm. The liberation percentage of Inorganic Fine Powder I was 13% by volume. Toner L was evaluated in the same manner as in Example 1. The results of evaluation are shown in Table 2.

Example 13

Toner M was obtained in the same manner as in Example 6 except that Inorganic Fine Powder J was used. Toner M had a weight-average particle diameter of 6.8 μm. The liberation percentage of Inorganic Fine Powder J was 12% by volume. Toner M was evaluated in the same manner as in Example 1. The results of evaluation are shown in Table 2.

Example 14

Toner N was obtained in the same manner as in Example 6 except that Inorganic Fine Powder K was used. Toner N had a weight-average particle diameter of 6.8 μm. The liberation percentage of Inorganic Fine Powder K was 12% by volume. Toner N was evaluated in the same manner as in Example 1. The results of evaluation are shown in Table 2.

Example 15

Toner O was obtained in the same manner as in Example 6 except that Inorganic Fine Powder L was used. Toner O had a weight-average particle diameter of 6.8 μm. The liberation percentage of Inorganic Fine Powder L was 11% by volume. Toner O was evaluated in the same manner as in Example 1. The results of evaluation are shown in Table 2.

Example 16

Toner P was obtained in the same manner as in Example 6 except that Inorganic Fine Powder A was used. Toner P had a weight-average particle diameter of 6.8 μm. The liberation percentage of Inorganic Fine Powder A was 8% by volume. Toner P was evaluated in the same manner as in Example 1. The results of evaluation are shown in Table 2.

Comparative Example 1

To 100 parts of Toner Base Particles A, 1.2 parts of hydrophobic fine silica particles (BET specific surface area: 85 $m^2/g$) obtained by surface-treating 100 parts of fine silica powder of 20 nm in primary particle diameter with 7 parts of hexamethyldisilazane, and 0.9 part of Comparative Inorganic Fine Powder A were externally added by means of a HENSCHEL MIXER (FM10B) (number of revolutions of blades: 66 revolutions/second; time: 3 minutes) to obtain Toner Q. Toner Q had a weight average particle diameter of 6.8 μm. The liberation percentage of Comparative Inorganic Fine Powder A was 5% by volume. Toner Q was evaluated in the same manner as in Example 1. The results of evaluation are shown in Table 2.

Comparative Example 2

Toner R was obtained in the same manner as in Comparative Example 1 except that Comparative Inorganic Fine Powder B was used. Toner R had a weight-average particle diameter of 6.8 μm. The liberation percentage of Comparative Inorganic Fine Powder B was 30% by volume. Toner R was evaluated in the same manner as in Example 1. The results of evaluation are shown in Table 2.

Comparative Example 3

Toner S was obtained in the same manner as in Comparative Example 1 except that Comparative Inorganic Fine Powder C was used. Toner S had a weight-average particle diameter of 6.8 μm. The liberation percentage of Comparative Inorganic Fine Powder C was 24% by volume. Toner S was evaluated in the same manner as in Example 1. The results of evaluation are shown in Table 2.

Comparative Example 4

To 100 parts of Toner Base Particles A, 1.2 parts of the same hydrophobic silica (BET specific surface area: 220 $m^2/g$) as that used in Example 6 and 1 part of Comparative Inorganic fine Power D were externally added by means of a HENSCHEL MIXER (FM10B) (number of revolution of blades: 66 revolutions/second; time: 3 minutes) to obtain Toner T. Toner T had a weight-average particle diameter of 6.8 μm. The liberation percentage of Inorganic Fine Powder D was 3% by volume. Toner T was evaluated in the same manner as in Example 1. The results of evaluation are shown in Table 2.

Comparative Example 5

Toner U was obtained in the same manner as in Comparative Example 1 except that Comparative Inorganic Fine Powder E was used. Toner U had a weight-average particle diameter of 6.8 μm. The liberation percentage of Comparative Inorganic Fine Powder E was 26% by volume. Toner U was evaluated in the same manner as in Example 1. The results of evaluation are shown in Table 2.

Comparative Example 6

Toner V was obtained in the same manner as in Comparative Example 1 except that Comparative Inorganic Fine Powder F was used. Toner V had a weight-average particle diameter of 6.8 μm. The liberation percentage of Comparative Inorganic Fine Powder F was 32% by volume. Toner V was evaluated in the same manner as in Example 1. The results of evaluation are shown in Table 2.

Comparative Example 7

Toner W was obtained in the same manner as in Comparative Example 1 except that Comparative Inorganic Fine Powder G was used. Toner W had a weight-average particle diameter of 6.8 μm. The liberation percentage of Comparative Inorganic Fine Powder G was 38% by volume. Toner W was evaluated in the same manner as in Example 1. The results of evaluation are shown in Table 2.

Comparative Example 8

Toner X was obtained in the same manner as in Comparative Example 1 except that Comparative Inorganic Fine Powder H was used. Toner X had a weight-average particle diameter of 6.8 μm. The liberation percentage of Comparative Inorganic Fine Powder H was 44% by volume. Toner X was evaluated in the same manner as in Example 1. The results of evaluation are shown in Table 2.

Comparative Example 9

Toner Y was obtained in the same manner as in Comparative Example 1 except that Comparative Inorganic Fine Powder I was used. Toner Y had a weight-average particle diameter of 6.8 μm. The liberation percentage of Comparative Inorganic Fine Powder I was 22% by volume. Toner Y was evaluated in the same manner as in Example 1. The results of evaluation are shown in Table 2.

TABLE 2

| | Mode 1 image density | | | | Mode 1 fog | | | |
|---|---|---|---|---|---|---|---|---|
| | 20° C./ 5% RH | 23° C./ 60% RH | 30° C./ 85% RH | 32.5° C./ 90% RH | 20° C./ 5% RH | 23° C./ 60% RH | 30° C./ 85% RH | 32.5° C./ 90% RH |
| Example: | | | | | | | | |
| 1 | A | A | A | B | A | A | A | B |
| 2 | A | A | A | B | A | A | B | B |
| 3 | A | A | A | B | A | A | A | B |
| 4 | A | A | A | B | A | A | A | B |
| 5 | A | A | A | B | A | A | B | B |
| 6 | A | A | A | A | A | A | A | A |
| 7 | A | A | A | A | A | A | A | A |
| 8 | A | A | A | A | A | A | A | B |
| 9 | B | A | A | A | A | A | B | B |
| 10 | A | A | A | B | A | A | A | B |
| 11 | A | A | A | A | A | A | A | A |
| 12 | A | A | A | B | A | A | A | B |
| 13 | A | A | A | A | A | A | B | B |
| 14 | B | A | A | A | A | A | A | B |
| 15 | B | A | A | A | A | A | A | B |
| 16 | A | A | A | A | A | A | A | A |
| Comparative Example: | | | | | | | | |
| 1 | B | A | A | B | A | A | A | B |
| 2 | B | A | A | B | A | A | C | C |
| 3 | A | A | A | B | A | A | C | C |
| 4 | A | A | A | B | A | A | B | B |
| 5 | A | A | A | B | A | A | B | B |
| 6 | C | A | A | B | A | A | B | B |
| 7 | B | B | B | C | B | A | C | C |
| 8 | B | B | B | C | B | A | C | C |
| 9 | A | A | A | B | A | A | C | C |

| | Mode 2 smeared images | | | Mode 3 smeared images | | | Latent image |
|---|---|---|---|---|---|---|---|
| | 20° C./ 5% RH | 23° C./ 60% RH | 30° C./ 85% RH | 20° C./ 5% RH | 23° C./ 60% RH | 32.5/ 90% RH | bearing member scratches |
| Example: | | | | | | | |
| 1 | A | A | A | C | B | A | *1 |
| 2 | A | A | A | C | B | A | *2 |
| 3 | A | A | B | C | B | B | *1 |
| 4 | A | A | A | C | B | A | *1 |
| 5 | A | A | A | C | B | A | *1 |

TABLE 2-continued

| | | | | | | | |
|---|---|---|---|---|---|---|---|
| 6 | A | A | A | A | A | A | *1 |
| 7 | A | A | A | A | A | A | *2 |
| 8 | A | A | B | B | B | B | *1 |
| 9 | A | A | B | B | B | B | *1 |
| 10 | A | A | B | B | B | B | *1 |
| 11 | A | A | A | A | A | A | *1 |
| 12 | A | A | B | C | B | B | *1 |
| 13 | A | A | B | B | B | B | *1 |
| 14 | A | A | A | B | B | A | *1 |
| 15 | A | A | A | B | B | A | *1 |
| 16 | A | A | A | C | C | A | *1 |
| Comparative Example: | | | | | | | |
| 1 | A | C | D | E | E | D | *1 |
| 2 | A | B | B | D | D | B | *5 |
| 3 | A | B | B | D | C | B | *5 |
| 4 | A | C | D | D | D | D | *1 |
| 5 | A | B | B | B | B | B | *4 |
| 6 | A | B | B | B | B | B | *5 |
| 7 | A | D | E | E | E | E | *5 |
| 8 | A | D | E | E | E | E | *5 |
| 9 | A | C | D | E | E | D | *3 |

1: None;
*2: Very slight;
*3: Slight;
*4: Many scratches;
*5: Many deep scratches;

This application claims priority from Japanese Patent Application Nos. 2003-321836 filed on Sep. 12, 2003 and 2004-135284 filed on Apr. 30, 2004, which are hereby incorporated by reference herein.

What is claimed is:

1. A toner comprising toner particles which comprise toner base particles having at least a colorant and a binder resin, and an inorganic fine powder, wherein;

said inorganic fine powder has a primary-particle average particle diameter of from 30 nm to 300 nm, and has particles having at least one of a cubic particle shape, a cube-like particle shape, a rectangular particle shape and a rectangle-like particle shape and having perovskite crystals;

said inorganic fine powder has particles and agglomerates both having particle diameters of 600 nm or more, in a content of 0% to 1% by number; and said inorganic fine powder is in a liberation percentage of 20% by volume or less with respect to the toner base particles.

2. The toner according to claim 1, wherein said inorganic fine powder contains 50% by number or more of the particles having at least one of a cubic particle shape, a cube-like particle shape, a rectangular particle shape and a rectangle-like particle shape.

3. The toner according to claim 1, wherein said inorganic fine powder is fine strontium titanate powder having undergone no sintering step.

4. The toner according to claim 1, wherein said inorganic fine powder contains 50% by number or more of the particles having at least one of a cubic particle shape, a cube-like particle shape, a rectangular particle shape and a rectangle-like particle shape, said inorganic fine powder is in a liberation percentage of 20% by volume or less with respect to the toner base particles, and said inorganic fine powder is fine strontium titanate powder having undergone no sintering step.

5. The toner according to claim 1, wherein said inorganic fine powder is added in an amount of from 0.05 part by weight to 2.00 parts by weight based on 100 parts by weight of the toner base particles.

6. The toner according to claim 1, which further comprises fine particles having a BET specific surface area of from 100 $m^2/g$ to 350 $m^2g$.

7. The toner according to claim 6, wherein said inorganic fine powder is surface-treated with a fatty acid having 8 to 35 carbon atoms or a metal salt of a fatty acid having 8 to 35 carbon atoms.

8. The toner according to claim 7, wherein said inorganic fine powder has a BET specific surface area of from 10 $m^2/g$ to 45 $m^2/g$.

9. The toner according to claim 7, wherein said inorganic fine powder has a contact angle with water of from 110° to 180°.

10. The toner according to claim 7, wherein said inorganic fine powder has a charge quantity of from 10 mC/kg to 80 mC/kg as absolute value, and has a charge polarity which is reverse to the polarity of said fine particles.

11. The toner according to claim 7, wherein said inorganic fine powder is fine strontium titanate powder having undergone no sintering step, and said fine particles are hydrophobic fine silica particles.

12. The toner according to claim 7, wherein said inorganic fine powder is added to the toner base particles in an amount of from 0.05 part by weight to 3.00 parts by weight based on 100 parts by weight of the toner base particles.

* * * * *